US006310595B1

(12) United States Patent
Shigeta

(10) Patent No.: US 6,310,595 B1
(45) Date of Patent: Oct. 30, 2001

(54) LIQUID CRYSTAL DISPLAY ELEMENT AND DRIVING METHOD THEREOF

(75) Inventor: Mitsuhiro Shigeta, Kashiwa (JP)

(73) Assignees: Sharp Kabushiki Kaisha, Osaka (JP); The Secretary of State for Defence in Her Britannic Majesty's Government of the United Kingdom of Great Britain and Northern Ireland, Farnborough (GB)

( * ) Notice: Subject to any disclaimer, the term of this patent is extended or adjusted under 35 U.S.C. 154(b) by 0 days.

(21) Appl. No.: 09/217,162

(22) Filed: Dec. 21, 1998

(30) Foreign Application Priority Data

Dec. 26, 1997 (JP) ..... 9-361209

(51) Int. Cl.[7] ..... G09G 3/36
(52) U.S. Cl. ..... 345/97
(58) Field of Search ..... 345/87, 97, 94, 345/88; 349/36, 38

(56) References Cited

U.S. PATENT DOCUMENTS 5,151,690 * 9/1992 Yamazaki ..... 340/784
5,936,689 * 8/1999 Saishu et al. ..... 345/97
5,999,157 * 12/1999 Ito et al. ..... 345/87

FOREIGN PATENT DOCUMENTS 07077946 3/1995 (JP) .
9507494 3/1995 (WO) .

OTHER PUBLICATIONS

S. Tomita et al.; Euro Display '96, pp. 251–254, 1996, "P–15: Transistor Sizing For AMLCD Integrated TFT Drive Circuits".
N.A. Clark et al., Appl. Phys. Lett. 36 (11), pp. 899–901, "Submicrosecond Bistable Electro–Optic Switching In Liquid Crystals" (1980).

* cited by examiner

*Primary Examiner*—Richard Hjerpe
*Assistant Examiner*—Ronald Laneau
(74) *Attorney, Agent, or Firm*—Renner, Otto, Boisselle & Sklar, LL

(57) ABSTRACT

A plurality of signal electrodes and scanning electrodes are provided on each of a pair of glass substrates facing each other, and pixels are formed at intersections of the signal electrodes and the scanning electrodes, and a liquid crystal layer is formed between the pair of glass substrates. A resistance value R of a single signal electrode or a single scanning electrode, an electric capacity C between the single signal electrode and one of the pair of glass substrates facing the single signal electrode, and a pulse width $\tau$ of a driving signal applied to the signal electrode or to the scanning electrode are set so as to satisfy a relationship $0.001 \leqq RC/\tau \leqq 0.5$.

6 Claims, 8 Drawing Sheets

LIQUID CRYSTAL DISPLAY ELEMENT AND DRIVING METHOD THEREOF

FIELD OF THE INVENTION

The present invention relates to a high-definition liquid crystal display element having a large screen, in which a voltage drop in electrodes is suppressed, and to a driving method thereof.

BACKGROUND OF THE INVENTION

A liquid crystal display device has such advantageous features as a flat display element that it is thin and light-weight, and has low power consumption and low driving voltage. For this reason, the liquid crystal display device is indispensable as a display of information devices, such as lap-top personal computers, word processors, portable terminals, and portable televisions.

At present, the liquid crystal display devices that are most commonly used are the ones adopting the STN (Super-Twisted Nematic) system, and the TN (Twisted Nematic) system employing TFTs (Thin Film Transistors) as the driving elements. However, these liquid crystal display devices all adopt nematic liquid crystal, and this presents many problems to be solved to realize high-definition and large capacity displaying.

The liquid crystal display device adopting the STN system has a relatively simple structure, in which a pair of transparent substrates, each having stripe transparent electrodes, are simply faced each other, and the device is driven by a driving system a so-called simple matrix driving system. This liquid crystal display device is desirable in terms of easy manufacturing and the manufacturing costs, yet due to the limitation of such characteristics as response speed of the liquid crystal and the applied voltage versus transmittance characteristic, the development of the device has come to the level where, practically, the number of scanning lines cannot be increased any further.

Meanwhile, the liquid crystal display device of an active-matrix system adopting TFTs offers full-color dynamic images, which are compatible with that produced by cathode-ray tubes. However, in this liquid crystal display device, it is required to provide the switching elements (TFTs) without causing a pixel failure in each pixel, and manufacturing becomes harder and harder as the display capacity is increased. This liquid crystal display device also has a problem that the transmittance is lowered by the arrangement wherein the switching element is provided on each pixel.

In order to solve these problems, liquid crystal display devices adopting ferroelectric liquid crystal have been getting an attention in recent years. As disclosed in Appl. Phys. Lett. 36(1980) pp. 899–901 (N. A. Clark and S. T. Lagerwall), the ferroelectric liquid crystal has desirable characteristics such as memory effect, high response speed, and wide viewing angle. For this reason, the liquid crystal display device of a simple-matrix system adopting ferroelectric liquid crystal is more suitable for high-definition displaying with large capacity pixels.

A conventional liquid crystal display device adopting ferroelectric liquid crystal is provided with a pair of electrode substrates facing each other and a liquid crystal layer of ferroelectric liquid crystal formed therebetween. One of the electrode substrates has an arrangement wherein a plurality of transparent signal electrodes are placed parallel to one another on a surface of a glass substrate, and a transparent insulating film and a transparent alignment film are formed thereon. The other electrode substrate has an arrangement wherein a plurality of transparent scanning electrodes are provided on a surface of a glass substrate so that the scanning electrodes are orthogonal to the signal electrodes, and a transparent insulating film and a transparent alignment film are deposited thereon. The alignment films are subjected to a uniaxial aligning process such as rubbing.

The ferroelectric liquid crystal is filled in a spacing formed between the glass substrates combined with each other by a sealing material. The glass substrates are sandwiched by a pair of polarizing plates which are so positioned that their polarization axes are orthogonal to each other. Between the alignment films are provided spacers as required.

As shown in FIG. 7, a molecule 51 of the ferroelectric liquid crystal has spontaneous polarization 52 in a direction orthogonal to its long axis direction. Also, the molecule 51 is subjected to a force proportional to the vector product of (i) an electric field generated by the driving voltage applied between the signal electrodes and the scanning electrodes and (ii) the spontaneous polarization 52, and is moved along the surface of cone trajectory 53.

Thus, to the observer, as shown in FIG. 8, the molecule 51 is perceived as though it is switching between positions $P_a$ and $P_b$ on the axes of liquid crystal trajectory. For example, when the pair of polarizing plates are positioned so that their polarization axes coincide with the direction of the arrow A–A' and the direction of the arrow B–B' of FIG. 8, respectively, a dark display is obtained when the molecule 51 is in the position $P_a$ and a light display produced by birefringence is obtained when the molecule 51 is in the position $P_b$.

The aligning states of the molecule 51 in the positions $P_a$ and $P_b$ are equivalent in terms of elastic energy, and for this reason the aligning states, that is, the optical states, are maintained even after the electric field is removed. This is called the memory effect, and is the unique property of the ferroelectric liquid crystal, which is not found in the nematic liquid crystal.

Therefore, in the liquid crystal display device in which the ferroelectric liquid crystal having such memory effect and having a high response speed as given by the spontaneous polarization is adopted to the simple matrix system, it is possible to carry out displaying with higher definition and larger capacity.

Incidentally, as disclosed in Tomita et al., Euro Display 96:, 251, in the active-drive liquid crystal display device adopting TFTs as the driving elements, conventionally, the delay time of the driving signal is defined by an RC equivalent circuit. In the TFT liquid crystal display, it is required that a pixel frequency $F_p$ and a time constant RC per line satisfy the relationship $F_p \cdot RC \leqq 1$. $F_p$ is in the order of several ten MHz, and the corresponding RC is in the order of nano seconds. This allows the TFT liquid crystal display to display dynamic images.

Meanwhile, the passive-drive liquid crystal display has not been examined thoroughly to realize dynamic image displaying, for the reason that the time constant RC is larger than that of the TFT liquid crystal display, and that there are only a few liquid crystal materials available which exhibit high speed response. Thus, even in the ferroelectric liquid crystal display having a potential to realize dynamic image displaying, no conditions for displaying dynamic images, namely, no relationship between the delay time (time constant RC) and the width $\tau$ Of the driving pulse had been obtained. RC and $\tau$ are both in the order of micro seconds. Therefore, the dynamic image display characteristics of the TFT liquid crystal display cannot be applied to the passive-drive liquid crystal display.

Japanese Unexamined Patent publication No. 77946/1995 (Tokukaihei 7-77946) discloses a method for changing the time constant in a passive-drive liquid crystal display device. In this method, a desired time constant is given per pixel by changing the resistance value of an electrode leading to the pixel in a static-drive liquid crystal display device. Because the effective value of the driving signal is changed in accordance with the time constant, the display color can be changed without using color filters.

When driving the liquid crystal display device by application of a voltage, the capacity formed between the electrodes (signal electrodes and scanning electrodes) and the substrates are charged and discharged repeatedly. Here, a charge is stored in and released from the capacity, and as a result a current flows into the liquid crystal cell via the electrodes. Also, the voltage applied to the liquid crystal is lower than the voltage applied to the input terminal of the electrodes due to the voltage drop caused by the resistance of the electrodes. Generally, the amount of voltage drop differs in different portions of the electrodes, and the voltage drop is largest at the ends of the electrodes.

For this reason, the amount of charge stored in the liquid crystal cell, that is, the current becomes relatively small. By this cause-and-effect relationship, the current value flowing through the light crystal cell and the voltage actually applied to the liquid crystal cell are different depending on the electric capacity and the electrode resistance of the liquid crystal cell.

In general, when the time constant RC as represented by the product of the electric capacity C and the electrode resistance R of the liquid crystal cell is large, and when the driving frequency is high, charge and discharge of the liquid crystal cell become insufficient, and as a result a large voltage drop results. Thus, when a rectangular driving pulse is applied to the liquid crystal, the rising portion and the falling portion of the waveform of the driving pulse are damped by the voltage drop.

Meanwhile, a liquid crystal cell adopting surface-stabilized ferroelectric liquid crystal (SSFLC) has an extremely thin cell gap of substantially 1 $\mu$m. Thus, the capacity of SSFLC is larger than that of TFT cell and STN cell, and accordingly, the time constant of the SSFLC cell is larger than that of TFT cell and the STN cell. Therefore, in the SSFLC cell, the voltage drop is more prominent compared with liquid crystal cells of other types.

When driving a liquid crystal cell having a large screen at a high speed to display dynamic images, the time constant takes substantially the same value as the driving pulse width, and charge and discharge of the liquid crystal cell become insufficient. As a result, the voltage drop in the liquid crystal cell is increased to substantially 5 percent to 70 percent. When the voltage drop in the electrodes becomes larger, lowering in contrast of the liquid crystal cell, nonuniformity, and gradation failure become more prominent, which all lower the display quality.

Also, while the method of Japanese Unexamined Patent publication No. 77946/1995 (Tokukaihei 7-77946) realizes different display colors by adjusting the time constant and thus changing the voltage drop per pixel in the static-drive liquid crystal display device, this method cannot suppress voltage drop in each electrode in the liquid crystal display device of a simple-matrix type.

SUMMARY OF THE INVENTION

It is an object of the present invention to improve a display quality by suppressing a voltage drop in electrodes.

In order to achieve this object, a liquid crystal display element of the present invention, including a pair of substrates facing each other, each having a plurality of electrodes in stripes, and a liquid crystal layer provided between the pair of substrates, the pair of substrates being faced with each other so that the plurality of electrodes are orthogonal to each other, is characterized in that a resistance value R per single electrode, an electric capacity C between a single electrode and one of the pair of substrates facing the single electrode, and a pulse width $\tau$ of a driving signal applied to the single electrode are set so as to satisfy a relationship $0.001 \leqq RC/\tau \leqq 5$.

In this arrangement, an electrode is regarded as an RC ladder equivalent circuit, and the above condition is set using the scaling law. Specifically, when an electric capacity (pixel) is C, and when the total resistance value between pixels in the electrode is R, considering the pixel as a node, the following diffusion equation (Equation (1)) is established with respect to nth node from the Kirchoff's law concerning current and voltage.

$$\frac{\partial V(x,t)}{\partial t} = \frac{\Delta^2}{CR}\frac{\partial^2 V(x,t)}{\partial X^2} \tag{1}$$

Here, when this diffusion equation is rewritten with a scaling parameter $\xi$ of $\xi=(RC/t)^{1/2}x/\Delta$, the voltage value V(x, t) at the distance between electrodes of $x=n\Delta$ is expressed by a function $V(\xi)$ with a variable of scaling parameter $\xi$. Accordingly, the amount of voltage drop is also expressed by the function $V(\xi)$. Therefore, even among displays having different screen size ($N\Delta$), pitch $\Delta$, resistance value R, capacity C, and pulse width $\tau$, the voltage and the amount of voltage drop take the same values among those displays, provided that the values of scaling parameters $\xi$ are the same.

With the characteristic of the scaling parameter $\xi$, by setting the values of scaling parameters $\xi$ at the same value in liquid crystal displays of different types, the display characteristics can be made the same. Thus, when a condition which does not have an adverse effect on a display image is obtained in a certain liquid crystal display element, in order to design a liquid crystal display element whose screen size (NΔ) and pulse width τ of a driving signal are different from that of the former liquid crystal display element, the scaling parameter ξ of the former liquid crystal display element is determined, and the resistance value R and the capacity value C are selected in such a manner that the scaling parameters ξ are the same in these liquid crystal display elements. As a result, as with the former liquid crystal display element, damping of the driving signal does not have an adverse effect on the display image of the latter liquid crystal display element.

Also, a voltage drop can be suppressed sufficiently when a liquid crystal display element has a scaling parameter ξ which is not more than the upper limit value of the scaling parameter ξ which is obtained by substituting the maximum pulse width τ, the resistance value R, and the capacity C into the function V(ξ), where the maximum pulse width τ is the value obtained in a domain in which the rate of change of the voltage drop is small (see FIG. 4(*a*)).

Thus, even among liquid crystal display elements having different screen size (NΔ) and different pulse width τ, by reducing the resistance value R of the electrode so that the scaling parameter ξ is not more than the upper limit value with respect to the waveform of the driving signal, it is possible to realize desirable image display. Also, in the case where the screen size (NΔ) and the electrode resistance R of the liquid crystal display element are determined beforehand, an appropriate pulse width τ can be obtained from the above function V(ξ).

Also, in order to achieve the above-mentioned object, a driving method of the present invention for driving a liquid crystal display element including a pair of substrates facing each other, each having a plurality of electrodes in stripes, and a liquid crystal layer provided between the pair of substrates, the pair of substrates faced each other so that the plurality of electrodes are orthogonal to each other, in which a voltage is applied to pixel regions of the liquid crystal layer, which are formed between the plurality of electrodes facing one another by application of a driving signal to each of the plurality of electrodes of the pair of substrates, is characterized by including the step of:

applying a driving signal having a pulse width τ to each of the plurality of electrodes, which satisfies a relationship:

$$0.001 \leqq RC/\tau \leqq 0.5$$

where R is a resistance value per single electrode, C is an electric capacity between a single electrode and one of the pair of substrates facing the single electrode, and τ is the pulse width τ of the driving signal applied to each of the plurality of electrodes.

With this method, it is possible to suppress the voltage drop in the electrodes, thus obtaining a desirable display quality.

For a fuller understanding of the nature and advantages of the invention, reference should be made to the ensuing detailed description taken in conjunction with the accompanying drawings.

BRIEF DESCRIPTION OF THE DRAWINGS

FIG. 4(*b*) is a waveform diagram showing a rectangular pulse used as the driving signal.

FIG. 5(*b*) is a front view showing the liquid crystal cell, which is divided into a left unit and a right unit to realize larger screen.

DESCRIPTION OF THE EMBODIMENTS

First Embodiment

The following will describe one embodiment of the present invention referring to FIG. 1 through FIG. 5.

Figure 3:
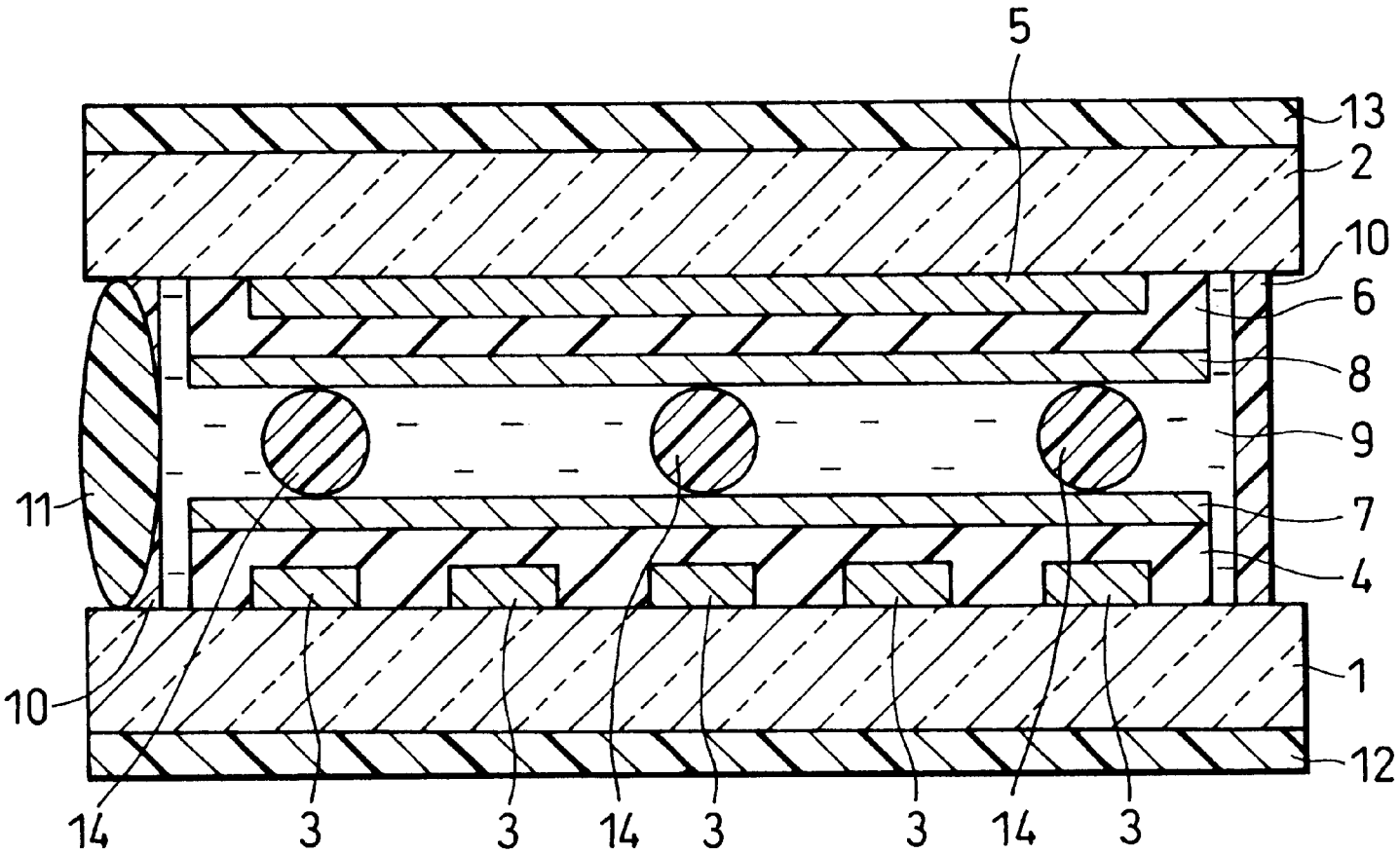
FIG. 3 is a cross sectional view showing a structure of the liquid crystal cell.

A liquid crystal cell (liquid crystal display element) in accordance with the present embodiment is provided with, as shown in FIG. 3, a pair of glass substrates 1 and 2, facing each other as transmissive substrates.

On a surface of the glass substrate 1 is formed a plurality of signal electrodes 3, parallel to one another, made of transparent conductor such as indium tin oxide (ITO), which are provided as transparent electrodes, and a transparent insulating film 4 made of, for example, silicon oxide ($SiO_2$) is deposited thereon.

On a surface of the glass substrate 2 is formed a plurality of transparent scanning electrodes 5 parallel to one another made of, for example, ITO, which are provided as transparent electrodes, so that the scanning electrodes 5 are orthogonal to the signal electrodes 3. The scanning electrodes 5 are covered by a transparent insulating film 6 made of, for example, $SiO_2$.

On surfaces of the insulating film 4 and 6 are formed alignment films 7 and 8, respectively, which have been subjected to a uniaxial aligning process, such as a rubbing process. As the alignment films 7 and 8, a film made of organic polymer such as polyimide, nylon, or polyvinyl alcohol, or alternatively a $SiO_2$ oblique vapor deposition film is adopted. In the case of adopting an organic polymer film as the alignment films 7 and 8, generally, the aligning process is carried out in such a manner that the liquid crystal molecules are aligned substantially parallel to electrode substrates.

A liquid crystal layer 9 is formed by filling ferroelectric liquid crystal in a spacing between the glass substrates 1 and 2 which are combined face to face by a sealing material 10. The ferroelectric liquid crystal is injected from an injection opening provided through the sealing material 10, and is sealed by sealing the injection opening by a sealant 11.

The glass substrates 1 and 2 are sandwiched by a pair of polarizing plates 12 and 13, which are positioned so that their polarization axes are orthogonal to each other. In the case where the display area is large, spacers 14 are disposed between the alignment films 7 and 8 to obtain a constant cell gap.

Square regions made by the signal electrodes 3 and the scanning electrodes 5 facing each other constitute pixel regions. Displaying is carried out in these pixel regions in which the displaying state is changed between light and dark states by switching of aligning state of the ferroelectric liquid crystal molecules constituting the liquid crystal layer 9, upon application of a voltage to the signal electrodes 3 and the scanning electrodes 5.

The following describes how the electrode substrates are manufactured in manufacturing steps of the liquid crystal cell.

First, on each of the glass substrates 1 and 2, ITO is deposited with a thickness of 200 nm by spatter vapor deposition or EB vapor deposition, and a photoresist (TSMR-8800) provided by Tokyo Ohka Kogyo Co., Ltd. is applied thereon. As the glass substrates 1 and 2, the 7059 glass substrate (136×136×1.1 mm) provided by Corning Inc. is used.

Then, after patterning the photoresist in stripes by photolithography using a photomask and a UV light irradiation device, the glass substrates 1 and 2 are soaked in 47 percent hydrobromic acid (HBr) for 10 minutes, which is maintained at a temperature of 35° C., so as to etch the ITO. As a result, the signal electrodes 3 and the scanning electrodes 5, each having a width of 385 $\mu$m is formed. The total length of pixel regions in a single signal electrode 3 and a single scanning electrode 5 is 96 mm each, and the distance between adjacent signal electrodes 3 and adjacent scanning electrodes 5 is 15 $\mu$m each.

Then, the glass substrates 1 and 2 are washed by pure water, and after drying the substrates, $SiO_2$ (silicon dioxide) or SiN (silicon nitride), etc., is deposited on each surface of the glass substrates 1 and 2 by spattering so as to cover the signal electrodes 3 and the scanning electrodes 5, thus forming the insulating films 4 and 6. Thereafter, the alignment films 7 and 8 made of polyimide are formed on the insulating films 4 and 6, respectively, and the alignment films 7 and 8 are subjected to a uniaxial aligning process. The glass substrates 1 and 2 are then combined with each other via the spacers 14, and the ferroelectric liquid crystal is injected therebetween, thus forming the liquid crystal layer 9.

In the liquid crystal cell as manufactured in this manner, the sheet resistance of the signal electrodes 3 and the scanning electrodes 5 are substantially 8 Ω, and a resistance of a single signal electrode 3 is 2 kΩ. Also, the electric capacity between the signal electrodes 3 and the facing glass substrate 2 is 8 pF per pixel, and is 2 nF per single signal electrode 3.

Figure 1:
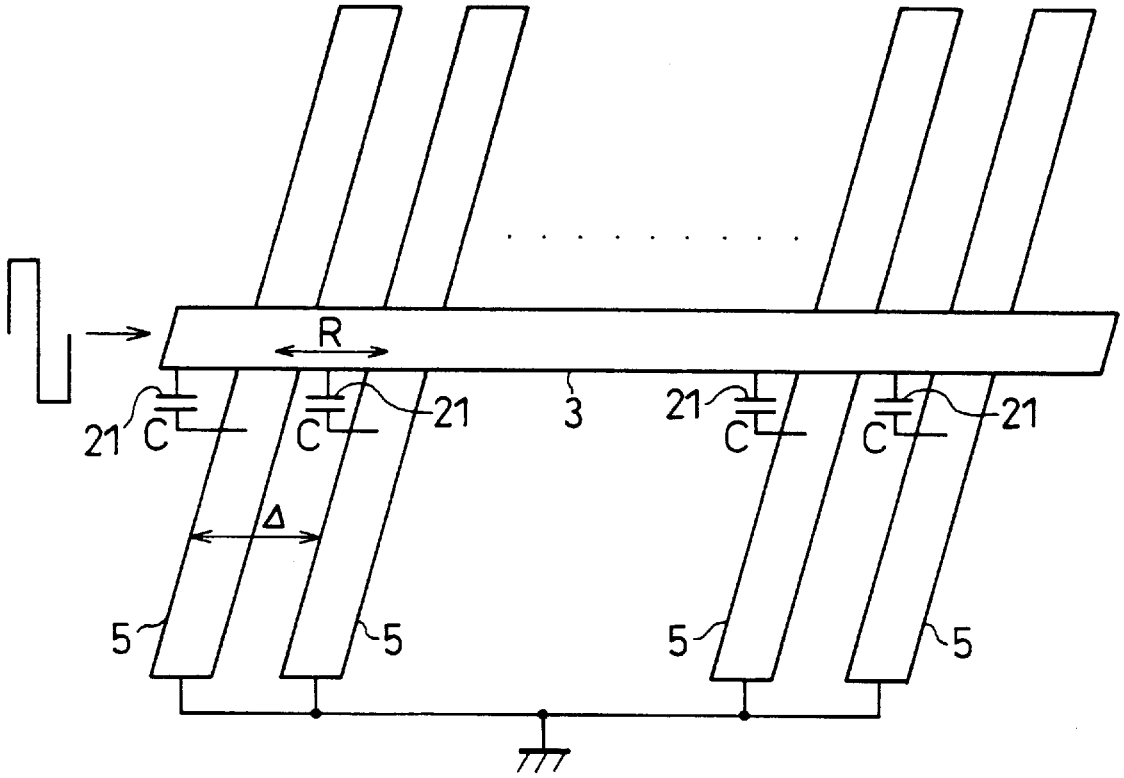
FIG. 1 is a perspective view showing a relationship between signal electrode (resistance) and pixel (capacity) in a liquid crystal cell in accordance with the present invention in an arrangement of the signal electrode and scanning electrodes.

As shown in FIG. 1, the signal electrode 3 has a resistance value R between each adjacent pixels 21, and each of pixels 21 formed between a single signal electrode 3 and the scanning electrodes 5 intersecting with each other has a capacity C. The intervals between adjacent pixels 21 along the signal electrode 3 is represented by Δ.

Figure 2:
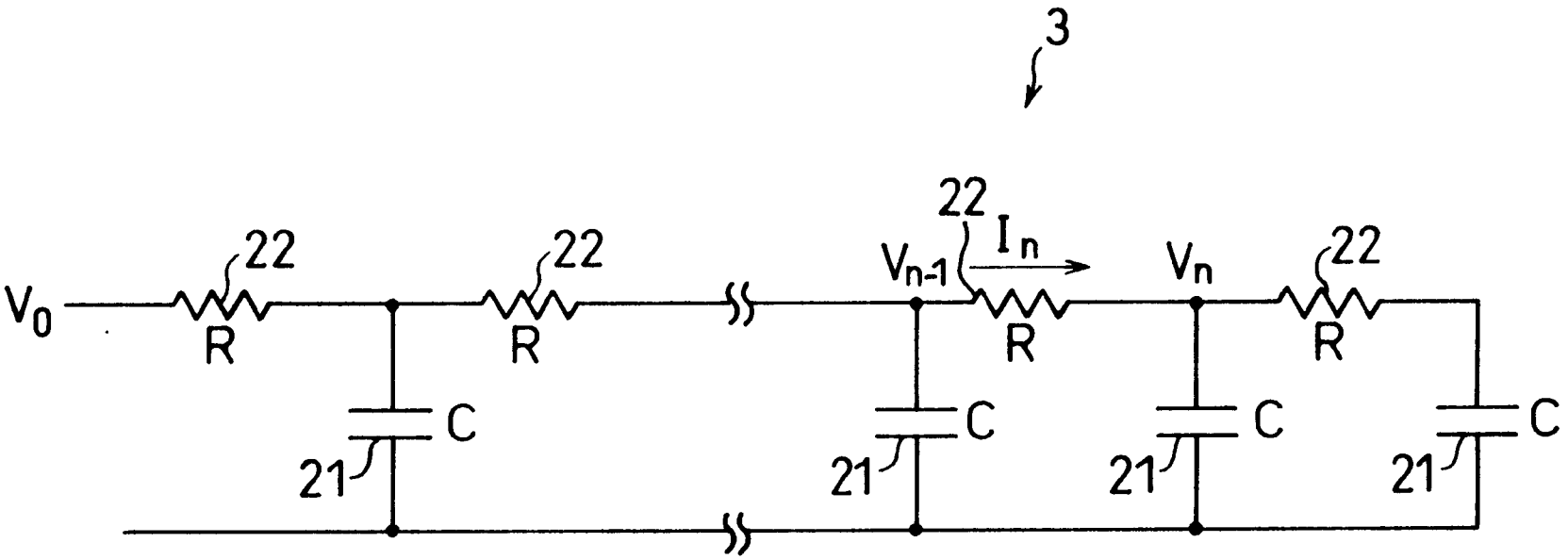
FIG. 2 is a circuit diagram showing an equivalent circuit of the signal electrode of FIG. 1.

The single signal electrode 3 in the arrangement of FIG. 1 is represented by an RC ladder equivalent circuit as shown in FIG. 2. In this equivalent circuit, resistances 22 each having a resistance value R are connected in series, and N pixels 21 each having a capacity C are connected on the bridges of the ladder. Here, when a voltage having the value of $V_0$ is applied to the signal electrode 3, the voltage applied to the nth pixel 21 is $V_n$, and the current which flows through the resistance 22 corresponding to the nth pixel 21 takes the value of $I_n$.

In this structure, when the pixel 21 is considered as a node, from the Kirchoff's law concerning current and voltage, the following diffusion equation (Equation (1)) is established with respect to nth node.

$$\frac{\partial V(x,t)}{\partial t} = \frac{\Delta^2}{CR}\frac{\partial^2 V(x,t)}{\partial X^2} \tag{1}$$

Here, t denotes time, Δ the distance (pitch) between nodes, and V (x, t) the voltage value at the distance x=nΔ. The scaling parameter ξ is represented by the following Equation (2).

$$\xi=(RC/t)^{1/2}x/\Delta \tag{2}$$

Thus, from Equation (2), the diffusion Equation (1) can be rewritten as the following Equation (3).

$$\frac{\xi\partial V(x,t)}{2\partial\xi} + \frac{\partial^2 V(x,t)}{\partial\xi^2} = 0 \tag{3}$$

From Equation (3), it can be seen that the voltage value (x, t) is expressed by the function V(ξ) with a variable of scaling parameter ξ. Accordingly, the amount of voltage drop $V_D=V(x,t)-V_0$ can also be expressed by the function V(ξ). Therefore, even among displays having different screen size (NΔ), pitch Δ, resistance value R, capacity C, and pulse width τ, the voltage value V(x, t) and the amount of voltage drop $V_D$ take the same values among those displays, provided that the values of scaling parameters ξ are the same.

With the characteristic of the scaling parameter ξ, by setting the values of scaling parameters ξ at the same value in liquid crystal displays of different types, the display characteristics can be made the same in the following manner. First, scaling parameter ξ of a certain liquid crystal display I is determined under the condition where damping of a driving signal does not have an adverse effect on a display image. Then, to design a liquid crystal display II whose screen size NΔ and pulse width τ of the driving signal are different from that of the liquid crystal display I, the resistance value R and the capacity value C are selected in such a manner that the liquid crystal displays I and II have the same scaling parameter ξ. As a result, as with the liquid crystal display I, damping of the driving signal does not have an adverse effect on the display image of the liquid crystal display II.

The driving signal waveform of the matrix electrodes of the liquid crystal cell is represented by the scaling parameter as described above. The following explains the relationship between the scaling parameter $\xi$ and the voltage drop.

Figure 4A:
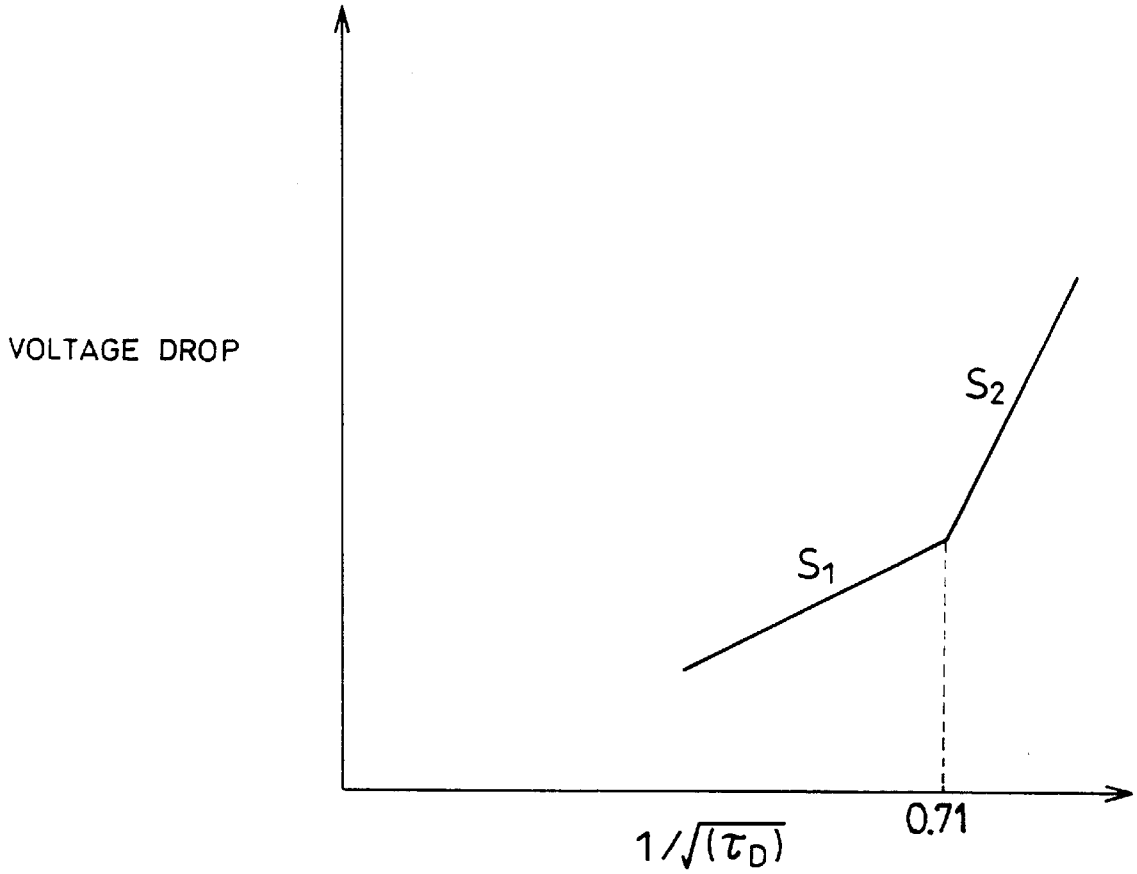
FIG. 4(*a*) is a graph showing how a driving signal is adversely affected by a voltage drop in the electrode of the liquid crystal cell.
Figure 4B:
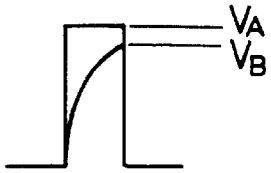

When a rectangular data pulse (driving signal) having a pulse width $\tau_D$ is applied to the signal electrode 3, as shown in FIG. 4(*b*), the data pulse have a pulse height $V_A$ at the input terminal of the signal electrode 3. However, at the end terminal of the signal electrode 3, the data pulse have a pulse height $V_B$ as a result of damping of the rising portion by a voltage drop. Therefore, the amount of voltage drop $V_D$ is represented by the difference ($V_A-V_B$) of the pulse widths. The amount of voltage drop $V_D=V_A-V_B$ is inversely proportional to the square root of the pulse width $\tau_D$, and therefore the relationship between voltage drop and $1/(\tau_D)^{1/2}$ can be represented by FIG. 4(*a*).

Thus, from this relationship, it can be seen that the amount of voltage drop $V_D$ is proportional to the scaling parameter $\xi_D=M(RC/\tau_D)^{1/2}$ of the signal electrode 3. Here, because M is the number of signal electrodes 3, $\xi_D$ can be rewritten as $\xi_D=[(RM)(CM)/\tau_D]^{1/2}$. RM denotes the total resistance values $R_D$ of a single signal electrode 3 (resistance value per single signal electrode 3), and CM denotes electric capacity $C_D$ between the single signal electrode 3 and the facing glass substrate 2. Thus, the scaling parameter $\xi_D$ of the signal electrode 3 is represented by the following equation (4).

$$\xi=(R_DC_D/\tau_D)^{1/2} \quad (4)$$

In the same manner, the scaling parameter $\xi_S$ when a selective pulse (driving signal) of a single rectangular wave having a pulse width $\tau_S$ is applied to the scanning electrode 5 is represented by the following equation (5).

$$\xi_S=(R_SC_S/\tau_S)^{1/2} \quad (5)$$

Here, $R_S$ denotes the total resistance value of a single scanning electrode 5 (resistance value per single scanning electrode 5), and $C_S$ denotes the electric capacity between the single scanning electrode 5 and the facing glass substrate 1.

As shown in FIG. 4(*a*), in domain $S_1$, the voltage drop is increased with an increase in $1/(\tau_D)^{1/2}$ (decrease in pulse width $\tau_D$), yet the amount of change is small. However, in domain $S_2$, in which the pulse width $\tau_D$ becomes smaller than the lower limit value in $S_1$, a change in voltage drop with respect to a change in pulse width $\tau_D$ becomes larger than that in domain $S_1$. Thus, when the pulse width $\tau_D$ is changed in domain $S_1$ and domain $S_2$ and the display quality of a still image and a dynamic image is observed, it was found that a desirable display quality is obtained when the pulse width $\tau_D$ is substantially not less than 8 $\mu$s. The same result was also obtained for the pulse width $\tau_S$.

Note that, in the present liquid crystal cell, as mentioned above, the electric capacity $C_D$ between the signal electrodes 3 and the facing glass substrate 2 is 2 nF (=$C_D$) per single signal electrode 3 (8 pF per pixel), and the resistance value $R_D$ per single signal electrode 3 is 2 kΩ.

Also, as the data pulse, a bipolar rectangular pulse with a voltage of 10 V was adopted, and as the selective pulse, a single rectangular wave with a voltage of 30 V was used. When driving the present liquid crystal cell using such data pulse and selective pulse, a pulse of 10 V is applied to the liquid crystal on a single signal electrode 3, except a selected single scanning electrode 5. In the described manner, the pulse width $\tau_D$ of data pulse and the pulse width $\tau_S$ of selective pulse were changed with respect to the present liquid crystal cell.

The upper limit value of the scaling parameter $\xi_D$, which was obtained by substituting the pulse width $\tau_D$ of the pulse widths $\tau_D$ and $\tau_S$, the resistance value $R_D$, and the capacity $C_D$ into Equation (4), is substantially 0.71, since a desirable display quality is obtained when the pulse width $\tau_D$ is substantially not less than 8 $\mu$s. Therefore, when the scaling parameter $\tau_D$ is not more than 0.71, it is possible to suppress the voltage drop sufficiently. This value of the scaling parameter $\xi_D$ coincides with the upper limit value of the scaling parameter $\xi_D$ in domain $S_1$ of FIG. 4(*a*). Thus, this result shows that a desirable display quality is obtained in domain $S_1$, in which the voltage drop is small. From this it follows that the upper limit value of $R_DC_D/\tau_D$ is 0.5 from Equation (4). Therefore, the liquid crystal display satisfying the relationship $R_DC_D/\tau_D \leqq 0.5$ is capable of realizing a desirable display quality and also capable of suppressing heat generation and power consumption of the signal electrodes 3 and the scanning electrodes 5.

Thus, as described, with the characteristic of the scaling parameter, even among liquid crystal displays having different screen size NΔ and different pulse width $\tau_D$, by reducing the resistance value $R_D$ of the signal electrode 3 so that the scaling parameter $\xi_D$ becomes not more than 0.71 with respect to the waveform of the driving signal, it is possible to realize desirable image display. Also, in the case where the screen size NΔ and the electrode resistance (resistance value $R_D$) of the liquid crystal display are determined beforehand, an appropriate pulse width $\tau_D$ can be obtained from Equation (4).

In order to reduce the resistance value $R_D$ for the purpose of reducing the scaling parameter $\xi_D$, the signal electrodes 3 were formed with Cu having a film thickness of 2000 nm. As a result, the resistance value $R_D$ was reduced to 4 Ω, and the scaling parameter $\xi_D$ of 0.0316 was obtained.

In this manner, the scaling parameter $\xi$ may be reduced by reducing the resistance value R or by increasing the pulse width $\tau$. However, there is a limit in reducing the resistance of wiring even when a metal material (Cu) is used for the wiring, and it is difficult to reduce the resistance value R infinitely small. Meanwhile, the capacity C is determined by the types of liquid crystal material or element structure used, and for this reason the capacity C does not change greatly. Also, in the case of applying the liquid crystal display element to a monitor, etc., displaying of a large capacity dynamic image is made difficult when the pulse width $\tau$ is increased. Therefore, in the actual liquid crystal display, the lower limit value of the scaling parameter $\xi$ is decided considering these limitations.

Generally, in a small liquid crystal display device, it is relatively easy to reduce the value of scaling parameter $\xi$ by the described method, compared with a larger liquid crystal display device, and by adopting metal wiring as above, the scaling parameter $\xi_D$ can be reduced to 0.0316. Therefore, from Equation (4), the lower limit value of $R_DC_D/\tau_D$ Of 0.001 is obtained.

Note that, the arrangement wherein the signal electrodes 3 (scanning electrodes 5) are formed with metal wires does not transmit light, and for this reason cannot be applied to a transmissive liquid crystal display element. However, this arrangement is applicable to a reflective liquid crystal display element.

From the above results, it was found that in order to carry out desirable image display, it is required that $R_D C_D/\tau_D$ with respect to the signal electrodes 3 and $R_S C_S/\tau_S$ with respect to the scanning electrodes 5 satisfy the following relations.

$$0.001 \leqq R_D C_D/\tau_D \leqq 0.5$$

$$0.001 \leqq R_S C_S/\tau_S \leqq 0.5$$

The following will describe a modification example of the present embodiment.

Generally, when the screen of a simple matrix liquid crystal display is increased, a large voltage drop results due to the fact that the electrode lines are long and accordingly the electrode resistance is high. Therefore, in order to solve this problem, it has been conventional practice to divide a display section into plural regions.

Figure 5A:
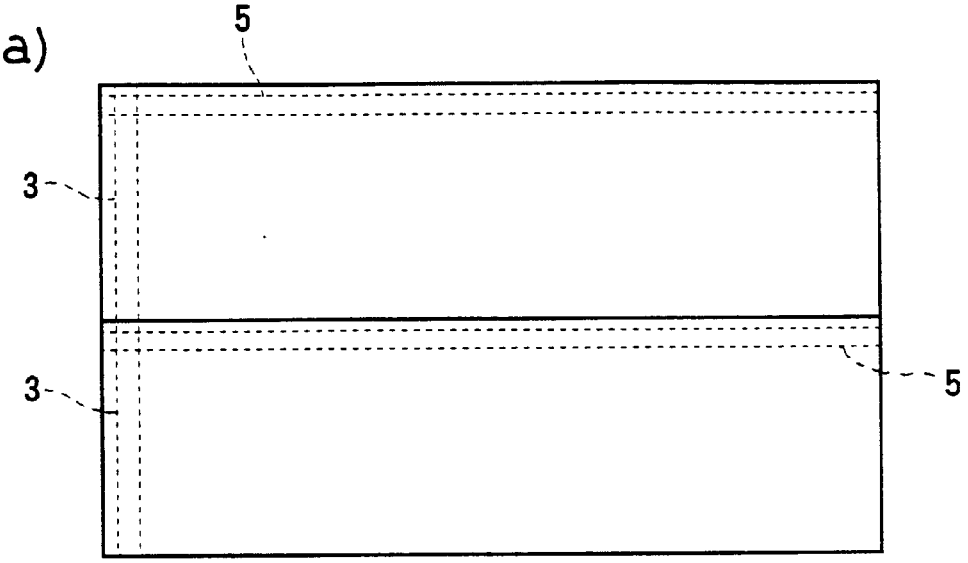
FIG. 5(*a*) is a front view of the liquid crystal cell, which is divided into an upper unit and a lower unit to realize larger screen.
Figure 5B:
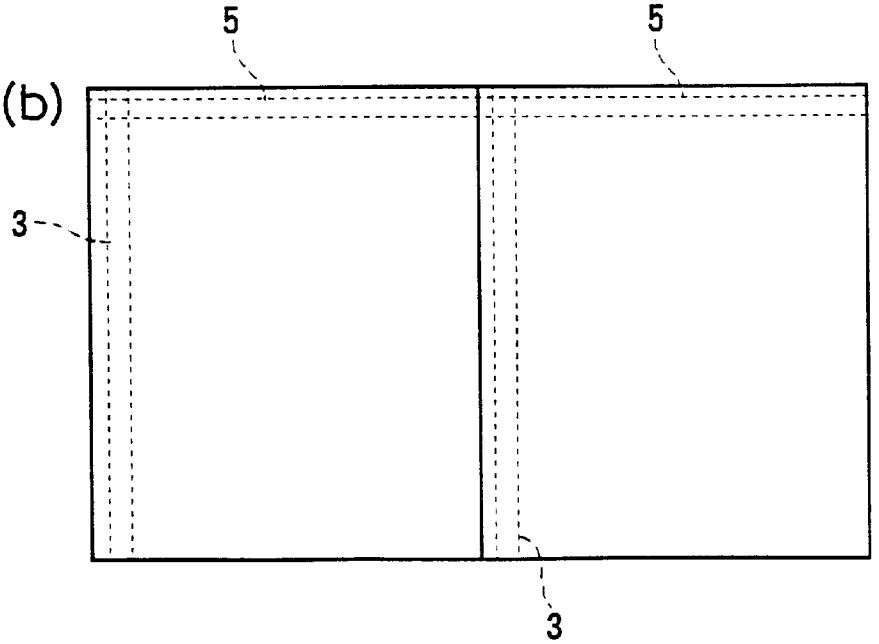

In the case of increasing the screen of the liquid crystal cell of the present embodiment, for example, as shown in FIG. 5 (*a*), the liquid crystal cell is divided into an upper unit and a lower unit, or as shown in FIG. 5(*b*), the liquid crystal cell is divided into a left unit and a right unit. Each of the divided cells is provided with, as with the single liquid crystal cell, a plurality of signal electrodes 3 and scanning electrodes 5 in matrix.

In this arrangement, the described conditions are also satisfied in each of the divided cells. As a result, it is possible to eliminate voltage drop in the signal electrodes 3 and the scanning electrodes 5 in each of the divided cells, thus realizing a desirable display quality in the large screen liquid crystal cell.

Note that, in the above example, the liquid crystal cell is divided into two units. However, not limiting to this, the liquid crystal cell may be divided into multiple units of more than two units, for example, into four units.

Second Embodiment

Figure 6:
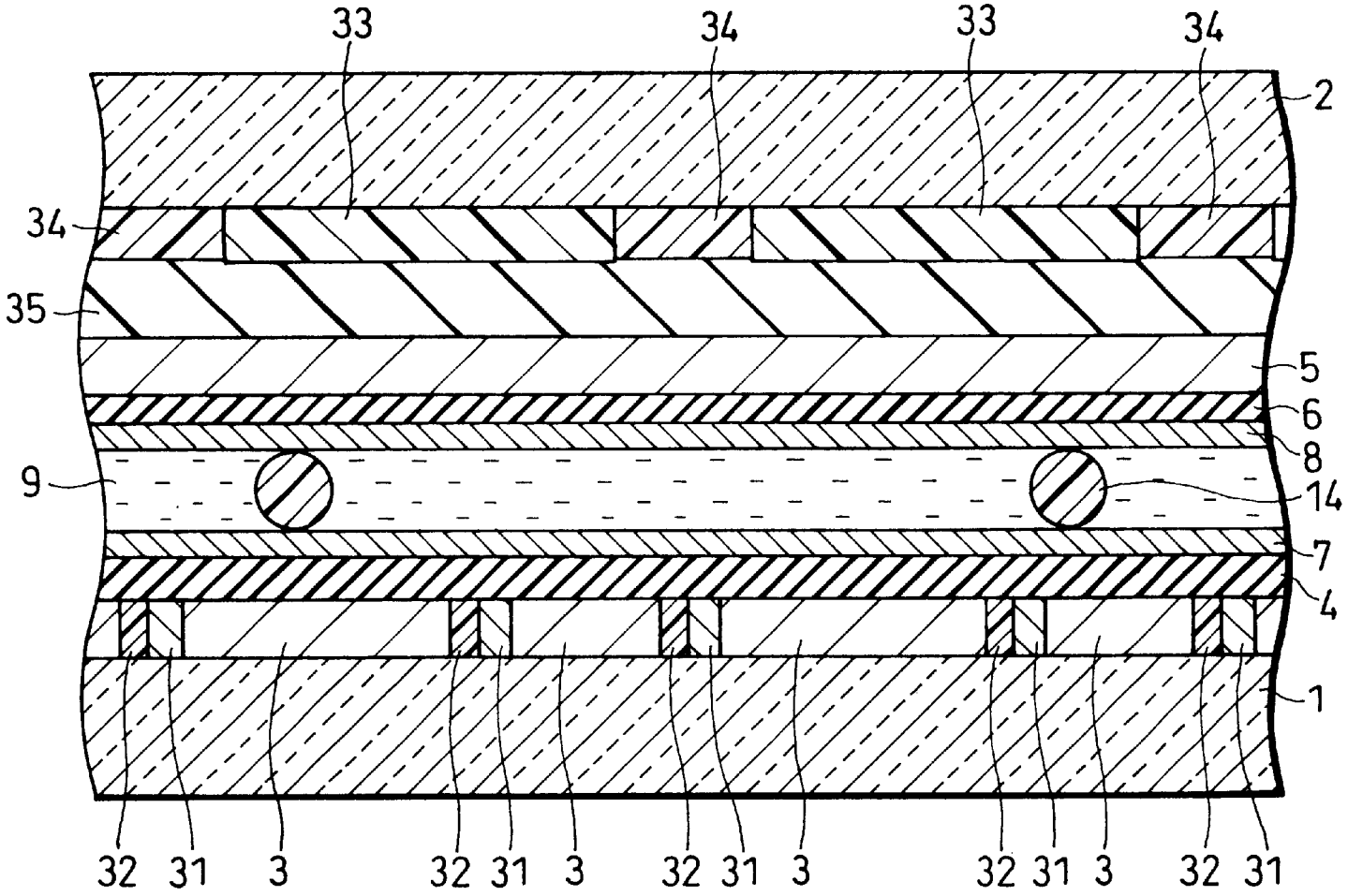
FIG. 6 is a cross sectional view showing a structure of a liquid crystal cell in accordance with another embodiment of the present invention.
Figure 7:
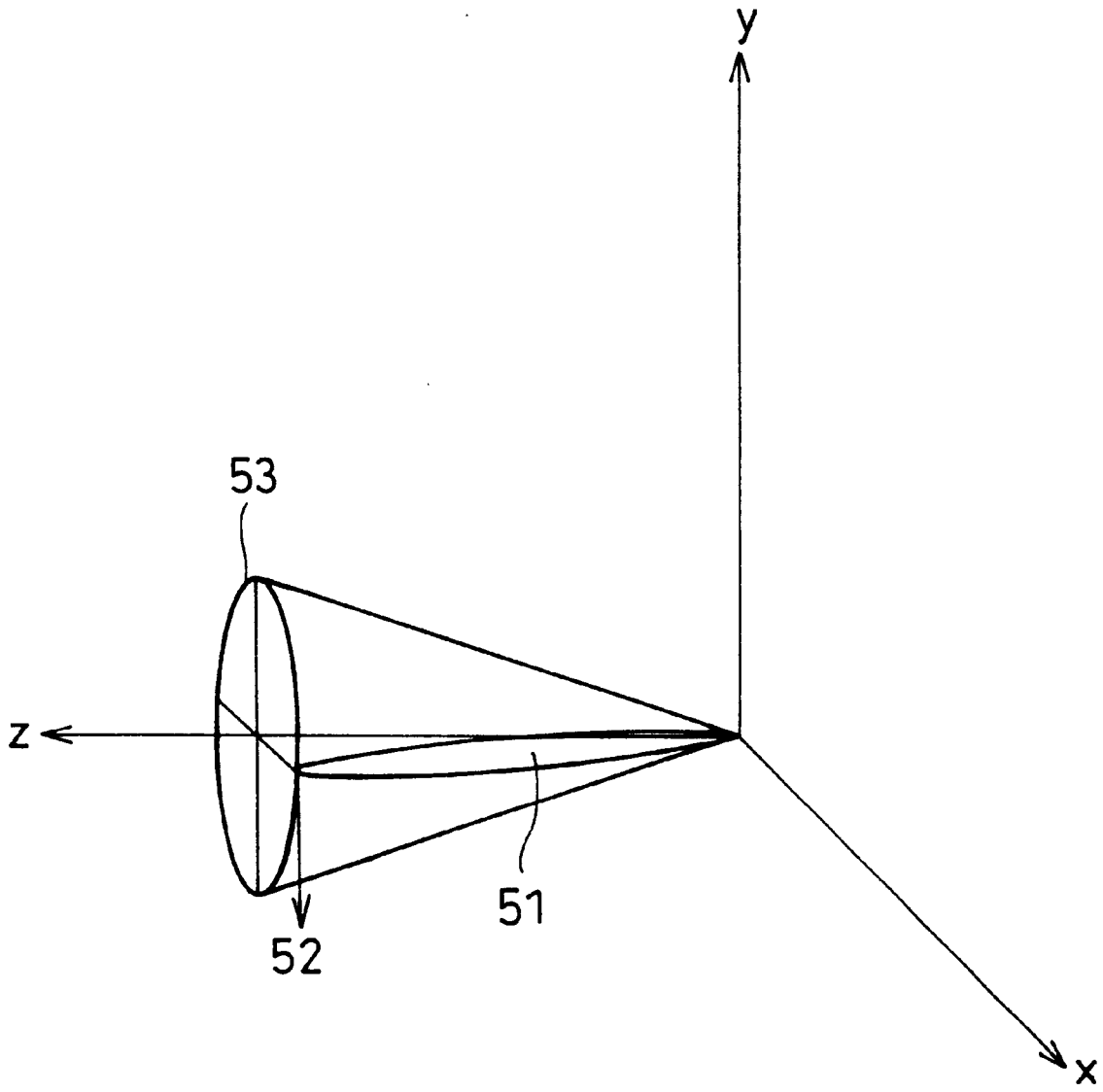
FIG. 7 is a perspective view showing a response of a ferroelectric liquid crystal molecule to an electric field.
Figure 8:
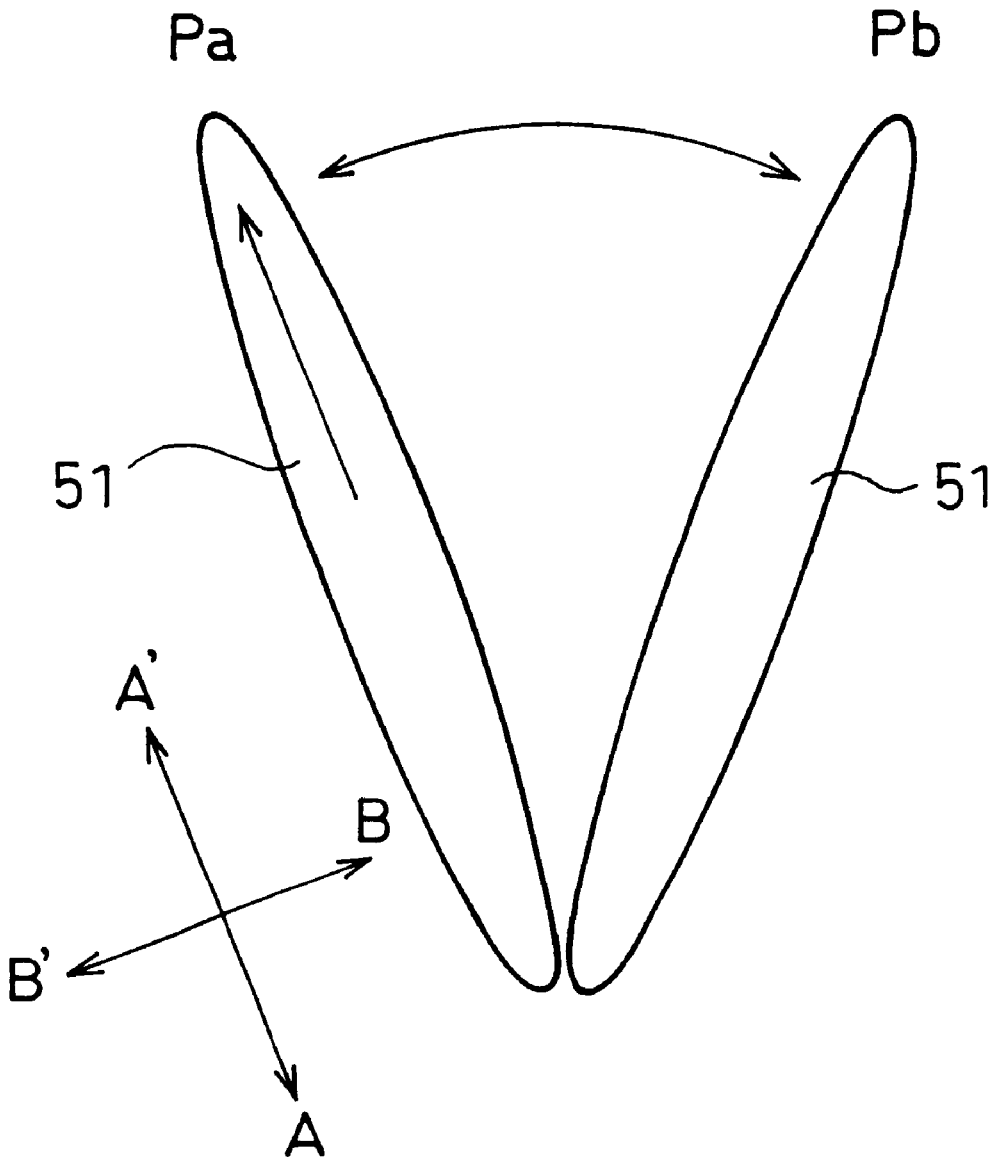
FIG. 8 is a plan view showing how the ferroelectric liquid crystal molecule is switched.

The following will describe another embodiment of the present invention referring to FIG. 5(*a*), FIG. 5(*b*), and FIG. 6. Note that, members having the same functions as the members described in First Embodiment are given the same reference numerals and explanations thereof are omitted here.

On a glass substrate 1, there are provided metal wires 31 made of metal having lower resistance than that of signal electrodes 3, for lowering the electrode resistance of the signal electrodes 3, between adjacent signal electrodes 3, so that the metal wires 31 make contact with only one of adjacent signal electrodes on the side surfaces in the lengthwise direction. Thus, the signal electrodes 3 and the metal wires 31 contact and conduct with each other on the side surfaces in the lengthwise direction of the signal electrodes 3. The metal wires 31 are made of metal and therefore have a desirable light-shielding ability. Accordingly, the metal wires 31 also function as a light-shielding film.

Between the signal electrodes 3 and the metal wires 31 contacting with one of adjacent signal electrodes 3 are provided light-shields 32 having insulation, such as silicon. The light-shields 32 fill gaps between the signal electrodes 3 and the metal wires 31, and are provided with the same thickness as that of the signal electrodes 3 and the metal wires 31. On the signal electrodes 31, the light-shields 32, and the metal wires 31 are provided an insulating film 4 and an alignment film 7 in this order.

The light-shields 32 block light transmitting through a non-display region other than the pixel regions, thus functioning as a black matrix, together with the metal wires 31. The signal electrodes 3, the metal wires 31, and the light-shields 32 are positioned adjacent to one another so that their surfaces constitute the same plane and there is no step-difference among these members.

Although not shown, on a glass substrate 2, there are provided color filters 33. Each of the color filters 33 is parted into regions for transmitting lights of red (R), green (G), and blue (B), and each region corresponds to the scanning electrode 5 one to one. Between the color filters 33 are provided black matrices 34. Further, on the color filters 33 is provided an overcoat film 33 of acrylic resin, which are commonly used for a color filter substrate.

On the overcoat film 33 are provided the scanning electrodes 5 and a plurality of metal wires, as with the First Embodiment. On top of this, an insulating film 6 and an alignment film 8 are provided in this order.

Note that, although not shown, between adjacent scanning electrodes 5 are provided metal wires, the same as the metal wires 31, parallel to one another so that the metal wires make contact with only one of adjacent scanning electrodes 5 on the side surfaces in the lengthwise direction. Also, between the scanning electrodes 5 and the metal wires contacting with one of the adjacent electrodes 5 are provided light-shields, the same as the light-shield 32.

The following describes how the electrode substrates are manufactured in manufacturing steps of the liquid crystal cell.

First, on the glass substrate 1, an ITO film is formed as a transparent conductive film with a film thickness of 200 nm by spatter vapor deposition or EB vapor deposition with respect to the entire surface. The color filters 33, the black matrices 34, and the overcoat film 35 are formed on the glass substrate 2, and as with the glass substrate 1, an ITO film is formed thereon.

The color filters 33 may be formed by a variety of conventionally known methods such as pigment diffusing method, dying method, electrodeposition method, and printing method. Also, the arrangement of the color filters 33 is not particularly limited, and various arrangements, for example, stripe arrangement, mosaic arrangement, and delta (triangle) arrangement, may be adopted depending on the use.

Then, as with manufacturing of the liquid crystal cell of the First Embodiment, stripe transparent electrodes (signal electrodes 3 and scanning electrodes 5) are formed by photolithography and etching. Here, the line width of each scanning electrode 5 is 385 $\mu$m, and the total length of the pixel regions of a single signal electrode 3 and a single scanning electrode 5 is 192 mm each. The distance between adjacent transparent electrodes is 15 $\mu$m.

Thereafter, the glass substrates 1 and 2, each deposited with photoresist are washed by pure water, and are dried.

Then, a metal film made of metal such as Cu, Al, and Ta, or made of alloy of these metals is formed by spatter vapor deposition or EB vapor deposition. Then, the metal film is etched using an etching solution having a main component of phosphoric acid. As a result, stripe metal wires, each having a width of 7.5 $\mu$m, parallel to and contacting with one of adjacent transparent electrodes are formed between adjacent transparent electrodes.

Then, silicon is deposited on the glass substrates 1 and 2 and on the photoresist by vapor deposition. Here, the amount of silicon deposited by vapor deposition is controlled so that the thickness of the metal wires 31 is substantially equal to the thickness (200 nm) of the transparent electrodes. It should be noted here that the thickness of silicon is not to exceed the thickness of the transparent electrodes. Then, the photoresist is lifted off together with the silicon, thus forming the light-shields made of silicon.

Thereafter, on each of the glass substrates 1 and 2 provided with the signal electrodes 3 and the scanning electrodes 5, etc., an insulating film (insulating films 4 and 6) is formed with $SiO_2$ or SiN, etc. On top of this, a polyimide alignment film (alignment films 7 and 8) is formed, and the polyimide alignment film is subjected to a uniaxial aligning process by rubbing. Then, the glass substrates 1 and 2 are faced each other via spacers 14, and ferroelectric liquid crystal is injected therebetween, thus completing the liquid crystal cell.

As with the liquid crystal cell of the First Embodiment, the conditions of the scaling parameter are also determined with respect to the present liquid crystal cell. In the present liquid crystal cell used here, the resistance value $R_D$ per single signal electrode 3 is 1 kΩ, the electric capacity between the signal electrodes 3 and the glass substrate 2 is 8 pF per pixel, and is 4 nF ($C_D$) per single signal electrode 3. Also, as the data pulse, a bipolar rectangular pulse of 10 V was used, and a single rectangular wave of 30 V was used as the selective pulse. When driving the present liquid crystal cell using such a data pulse and selective pulse, a pulse of 10 V is applied to the liquid crystal on a single signal electrode 3, except a selected single scanning electrode 5. In the described manner, the pulse width $\tau_D$ of data pulse and the pulse width $\tau_S$ of selective pulse were changed with respect to the present liquid crystal cell.

As a result, as with the First Embodiment, it was found that a desirable display quality is obtained when the pulse widths $\tau_D$ and $\tau_S$ of the data pulse and the selective pulse, respectively, are substantially not less than 8 $\mu$s. The upper limit value of the scaling parameter $\xi_D$, which was obtained by substituting the pulse width $\tau_D$ of the pulse widths $\tau_D$ and $\tau_S$, the resistance value $R_D$, and the capacity $C_D$ into Equation (4), is substantially 0.71. Therefore, when the scaling parameter $\tau_D$ is not more 0.71, no voltage drop results, and a desirable display quality is obtained. In order to reduce the resistance value $R_D$ for the purpose of reducing the scaling parameter $\xi_D$, the signal electrodes 3 (scanning electrodes 5) were formed with Cu having a film thickness of 5000 nm. As a result, the resistance value $R_D$ was reduced to 2 Ω, and the scaling parameter $\xi_D$ of 0.0316 was obtained. It was also found that the conditions $R_DC_D/\tau_D$ and $R_SC_S/\tau_S$ are required to satisfy for obtaining this result are expressed by the following equations.

$$0.001 \leqq R_DC_D/\tau_D \leqq 0.5$$

$$0.001 \leqq R_SC_S/\tau_S \leqq 0.5$$

Note that, the present embodiment described the structure in which the metal wires 31, each having a width of 7.5 $\mu$m, are provided on one side of the signal electrodes 3 and the scanning electrodes 5 so as to reduce the resistance value $R_D$ per single signal electrode 3. However, the present embodiment is not limited to this, and the same result was also obtained when the metal wires 31, each having a width of 3.8 $\mu$m, are provided on both sides of the signal electrodes 3 and the scanning electrodes 5.

The following describes a modification example of the present embodiment.

In the present embodiment, as with the First Embodiment, in the case of increasing the screen of the liquid crystal cell, as shown in FIG. 5(*a*), the liquid crystal cell is divided into an upper unit and a lower unit, or as shown in FIG. 5(*b*), the liquid crystal cell is divided into a left unit and a right unit.

In this arrangement, the described conditions are also satisfied in each of the divided cells. This eliminates the voltage drop in the signal electrodes 3 and the scanning electrodes 5 in each of the divided cells, thus realizing a desirable display quality in the large screen liquid crystal cell.

As described, the liquid crystal display element in accordance with the present invention has an arrangement including a pair of substrates (glass substrates 1 and 2) facing each other, each having a plurality of electrodes (signal electrodes 3 or scanning electrodes 5) in stripes, and the liquid crystal layer 9 provided between the pair of substrates, the pair of substrates faced each other so that the plurality of electrodes are orthogonal to each other, wherein a resistance value R per single electrode, an electric capacity C between a single electrode and a facing substrate, and a pulse width τ of a driving signal applied to the single electrode are set so as to satisfy a relationship $0.001 \leqq RC/\tau \leqq 0.5$.

This range of RC/τ is the condition which is determined by the scaling law, regarding the electrode as an RC ladder circuit. Therefore, even among displays having different resistance value R, capacity C, and pulse width τ, when the values of scaling parameters ξ ($\xi=(RC/\tau)^{1/2}$) are the same, the values of voltage and voltage drop take the same values. Thus, with the characteristic of the scaling parameter ξ, by setting the scaling parameters ξ at the same value in different liquid crystal displays, it is possible to obtain the same display characteristic. Thus, even among display displays having different screen size NΔ and different pulse width τ, when RC/τ is set within the above range, it is possible to suppress the voltage drop sufficiently, thus realizing a desirable display quality.

Also, in the liquid crystal display element in accordance with the present invention, when dividing the display section into plural regions (for example, into two units of upper and lower units, or left and right units) to increase the screen size of the liquid crystal display element, for the purpose of reducing the length of the electrode lines so as to prevent a large voltage drop as a result of increased electrode resistance, the display section of each substrate is divided into two regions along the lengthwise direction of the electrodes of the one of the substrates, and the resistance value R, the electric capacity C, and the pulse width $\tau$ are set in each of the divided regions so as to satisfy the relationship $0.001 \leqq RC/\tau \leqq 0.5$. Therefore, the voltage drop is suppressed sufficiently even in a simple matrix liquid crystal display element having a large screen, thereby realizing a desirable display quality.

Also, in a driving method of a liquid crystal display element in accordance with the present invention, in the described liquid crystal display element, a driving signal having a pulse width $\tau$ satisfying the above relationship is applied to the electrodes. As a result, the voltage drop is suppressed sufficiently, and it is possible to reduce heat generation and power consumption of the electrodes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display element including a pair of substrates facing each other, each having a plurality of electrodes in stripes, and a liquid crystal layer provided between the pair of substrates, the pair of substrates being faced with each other so that the plurality of electrodes are orthogonal to each other, wherein each of the plurality of electrodes forms an RC ladder circuit having a resistance between adjacent pixels and a capacitance between the electrode and an opposing electrode at each pixel, and wherein a sum resistance value R per single electrode, a sum electric capacity C between a single electrode and one of the pair of substrates facing the single electrode, and a pulse width $\tau$ of a driving signal applied to the single electrode are set so as to satisfy a relationship $0.001 \leqq RC/\tau \leqq 0.5$.

2. The liquid crystal display element as set forth in claim 1, wherein a display section of the pair of substrates is divided into a plurality of regions along a lengthwise direction of the plurality of electrodes of one of the pair of substrates, and the resistance value R, the electric capacity C, and the pulse width $\tau$ are set so as to satisfy the relationship $0.001 \leqq RC/\tau \leqq 0.5$ in each of divided regions.

3. The liquid crystal display element as set forth in claim 1, wherein the liquid crystal layer is made of ferroelectric liquid crystal.

4. The liquid crystal display element as set forth in claim 1, wherein the plurality of electrodes of at least one of the pair of substrates are made of a metal material.

5. A driving method of a liquid crystal display element including a pair of substrates facing each other, each having a plurality of electrodes in stripes, and a liquid crystal layer provided between the pair of substrates, the pair of substrates faced each other so that the plurality of electrodes are orthogonal to each other, in which a voltage is applied to pixel regions of the liquid crystal layer, which are formed between the plurality of electrodes facing one another by application of a driving signal to each of the plurality of electrodes of the pair of substrates, wherein each of the plurality of electrodes forms an RC ladder circuit having a resistance between adjacent pixels and a capacitance between the electrode and an opposing electrode at each pixel, said driving method including the step of:

applying a driving signal having a pulse width $\tau$ to each of the plurality of electrodes, which satisfies a relationship:

$$0.001 \leqq RC/\tau \leqq 0.5$$

where R is a resistance value per single electrode, C is a sum electric capacity between a single electrode and one of the pair of substrates facing the single electrode, and $\tau$ is the pulse width $\tau$ of the driving signal applied to each of the plurality of electrodes.

6. The driving method of a liquid crystal display element as set forth in claim 5, wherein the liquid crystal is made of ferroelectric liquid crystal.

* * * * *